US006748893B1

(12) United States Patent
Jorde et al.

(10) Patent No.: US 6,748,893 B1
(45) Date of Patent: Jun. 15, 2004

(54) FOIL SYSTEM DEVICE FOR VESSELS

(76) Inventors: Jens-Herman Jorde, Straumshaugen 14, Straumsgrend (NO), 5151; Jan Ingar Norheim, Hardangerfjordvegon 223, Norheimsund (NO), 5600

( * ) Notice: Subject to any disclaimer, the term of this patent is extended or adjusted under 35 U.S.C. 154(b) by 0 days.

(21) Appl. No.: 09/869,546

(22) PCT Filed: Dec. 28, 1999

(86) PCT No.: PCT/NO99/00404

§ 371 (c)(1),
(2), (4) Date: Aug. 27, 2001

(87) PCT Pub. No.: WO00/38971

PCT Pub. Date: Jul. 6, 2000

(30) Foreign Application Priority Data

Dec. 29, 1998 (NO) ..... 986169

(51) Int. Cl.[7] ..... B63B 1/24
(52) U.S. Cl. ..... 114/274; 114/281; 114/61.1
(58) Field of Search ..... 114/271, 274–282, 114/61.1, 61.11–61.19

(56) References Cited

U.S. PATENT DOCUMENTS

| | | | | | |
|---|---|---|---|---|---|
| 2,081,868 | A | * | 5/1937 | Hampden | 114/274 |
| 2,341,159 | A | * | 2/1944 | Neklutin | 114/274 |
| 2,749,871 | A | * | 6/1956 | Scherer et al. | 114/276 |
| 2,914,014 | A | * | 11/1959 | Carl et al. | 114/281 |
| 2,984,197 | A | * | 5/1961 | Bader | 114/282 |
| 3,027,862 | A | * | 4/1962 | Votre | 440/12.54 |
| 3,092,062 | A | * | 6/1963 | Savitsky | 114/277 |
| 3,137,260 | A | * | 6/1964 | Harris, Jr. et al. | 114/275 |
| 3,221,698 | A | * | 12/1965 | Turner | 114/278 |
| 3,294,055 | A | * | 12/1966 | McGuire | 114/55.55 |
| 3,988,994 | A | | 11/1976 | Nitzki | |
| 4,100,876 | A | * | 7/1978 | Feleus | 114/274 |
| 4,356,786 | A | * | 11/1982 | Tuggle | 114/280 |
| 5,018,686 | A | * | 5/1991 | Zimmer | 244/106 |
| 5,373,800 | A | * | 12/1994 | Steinberg | 114/282 |
| 5,503,100 | A | * | 4/1996 | Shaw | 114/274 |
| 5,592,895 | A | * | 1/1997 | Schmidt | 114/274 |
| 5,645,008 | A | * | 7/1997 | Loui | 114/274 |
| 5,794,558 | A | * | 8/1998 | Loui | 114/274 |
| 6,167,829 | B1 | * | 1/2001 | Lang | 114/278 |

FOREIGN PATENT DOCUMENTS

| | | |
|---|---|---|
| SE | 331802 | 1/1971 |

* cited by examiner

*Primary Examiner*—S. Joseph Morano
*Assistant Examiner*—Ajay Vasudeva
(74) *Attorney, Agent, or Firm*—Francis C. Hand; Carella, Byrne, Bain et al.

(57) ABSTRACT

There is disclosed a foil system for hydrofoil vessels, where the foil system lifts and carries the total weight of the craft at speed, and comprising a number of adjustable control fins/-surfaces (3–5), supporting legs (7–9) between the foil system and the hull of the vessel, and means to adjust the control fins/-surfaces. The foil system is characterized in that it is formed by one single approximately horizontal foil body comprising two generally mirror symmetric foil arms (1, 2) which extend aft to each side in almost equal angle, in that the forward corner of the angle lies in the center line (11) of the craft, and the foil arms extend aft to each side in an almost equal angle (12) with the longitudinal centerline (11) of the craft.

17 Claims, 2 Drawing Sheets

FOIL SYSTEM DEVICE FOR VESSELS

The present invention refers to a device of a foil system for hydrofoil craft, where the foil system comprises a number of adjustable control fins/surfaces, struts between the foil system and the hull of the craft, and means to regulate the control fins/surfaces, and at speed, the foil system is arranged to be completely submerged and lifts and carries the total weight of the craft.

One of the problems associated with obtaining high speeds in conventional marine craft is the wave pattern by which these are surrounded. With increasing speed the resistance will increase rapidly even if the craft has a favourable shape. To reduce this problem it is known technology to employ surfaces with dynamic lift. In this way the craft is lifted to a greater or lesser degree out of the water and the wave generated resistance is reduced.

In the case that these surfaces consist of the craft's bottom (planing craft) the surfaces must necessarily be so large that the shearing forces (the viscous forces) become large and the resistance will consequently be large at high speeds. The most effective surfaces to create lift with least possible resistance are wing profiles (foils). These wing profiles can be either completely submerged or piercing the water surface. Such marine craft where the foil system lifts and carries the total weight of the craft at speed, are known as hydrofoil craft, and reference is made to U.S. Pat. Nos. 2,749,871, 3,092,062 and 3,137,260.

The Swedish patent No. SE-331.802 discloses a foil structure which is intended for piercing the water surface. Said foil structure consists of a foremost foil member cooperating with a central main foil member which carries the main of the craft's weight. The foremost foil member carries the remainder weight of the craft. Thus the structure always operates with two separate foil members. The foremost foil comprises two central sections of the body making an angle of approx. 35° with the horizontal, and two perphery sections each with an angle of 15°. The outer inclined side sections of the foil body are arranged to pierce the water surface. Thus some of said foil body is always above the water level at speed, thus exhibiting an upper dry surface. The foil is therefore partly planing on/along the surface of the sea. The foremost foil member is necessary to stabilize the craft in pitch at high speed, when riding on the main foil member which is positioned amidships. The foil structure does not include contol surfaces to control the vessel, and therefore it is self-adjusting.

By providing the dynamic lift from either the bottom section of a craft or from a foil system piercing the water surface, the variation in vertical forces will become large. This leads to high accelerations on the craft and unpleasantness for those aboard (Ref. ISO 2631). This may be avoided to a greater or lesser degree by moving the lifting surfaces completely below the water surface, where the conditions are calmer. This has proven to be the superior method in many ways and has been used on several hydrofoil craft, but has also led to a number of disadvantages.

The lift from a wing depends on the geometric profile of the wing, the mass density of the water, the projected area of the wing in the vertical sense and the relative velocity between the wing and the surrounding water. Since the lift must have the same magnitude as the total weight of the craft, and since both weight and velocity can vary it must be possible to vary the geometry of the wing, alternatively to vary the area of the wing as is done for a hydrofoil craft with surface piercing wings. The variation in the geometry of the wing is commonly effected by mounting several flaps on the following edge of the wing or wings.

The present invention relates to a foil system including only one foil element with accompanying control surfaces which by their arrangement can control a craft having its hull at some distance above the water both in pitch and roll.

For existing or disclosed hydrofoil craft the motions of the craft can be monitored or measured, so that these measurements can be used in a control system for continuous adjustment of the flap angle on the different wings and hence assure that the lifting force at any time is adapted to the craft's weight, the location of the centre of gravity and existing mass forces. This will ensure a very pleasant voyage even in rough seas, and has been employed on several types of hydrofoil craft. All known hydrofoil craft utilise either several wings or a combination of dynamic lift from one or several wings combined with buoyancy from one or more submerged hulls in order to maintain longitudinal and/or transverse stability.

By using dynamic lift from several wings or by combining lift from wings and hulls, however, other difficulties and disadvantages are introduced. Of particular importance in the context of the present invention, the following five issues can be mentioned:

i) During the take-off stage the resistance of the wings will be disproportionally larger than at full speed. This is associated with the high lift coefficient which is necessary at low speeds, and which partly is caused by the low speed, but which also can be ascribed to the low aspect ratio usually found on such wings, and which leads to an unusually high induced drag. At the same time the resistance of the hull will be high, which is associated with the desire to obtain dynamic lift from the hull itself in order to reduce the resistance at high speed, but gives at the same time rise to a high resistance curve at low speeds. The resistance curve for a hydrofoil craft will consequently often have a pronounced peak (a hump) resulting in engine overload in this speed regime.

By an aspect ratio is meant the ratio between the span and the chord of the wing, the span being the extent of the wing in the transverse direction of the craft, and the chord is the extent of the wing in the longitudinal direction of the craft, in a typical section.

ii) Since the bottom of the hull itself must be relatively flat, great clearance between the sea surface and the bottom will be necessary in order to avoid high slamming loads in waves. Such slamming loads will result in damage to the flat bottom, or if they are not that fierce, to discomfort in the behaviour of the craft and anxiety among the passengers.

iii) this large clearance will also lead to problems with the propulsors (the drive means), and if they consist of some sort of propellers they must be fixed to long struts, and the powering shafts become long and the propellers attain a sharp inclination relative to the water stream. If they consist of water jets the large distance between the inlets—which must be located at some distance below the water surface, and the pumps—which have to be located inside the hull, will lead to large losses in the inlet, both due to the length of the intake and the abrupt velocity changes necessary to bring the water up to the hull where the pumps are located.

iv) the large clearance desirable to maintain the distance between the wings and the hull involves an unallowably large draught at zero speed. This entails that the wings must be supported by struts which can be lifted/folded in one manner or another. Such compliant structures involve introduction of mechanisms both to ensure the folding, but also mechanisms transferring forces and moments down to the wings. This system will hence be more complicated and demand more maintenance than a fixed system.

v) Since the hull itself must be kept at adequate distance from the undisturbed water surface, this means that a possible failure in the control system or a breakage of one or several of the struts or wings, brought about by e.g. collision with a log, will lead to a fall against the water surface before the buoyancy of the hull again balances the weight of the craft. The potential energy such a craft contains due to the height above the water surface, means that such a fall can be very dramatic with a violent and uncontrolled retardation of the speed. For passengers not being secured such an event can be very dramatic.

It is possible to improve considerably on the five crucial points mentioned above by using a different configuration of the hull and the wings than that which has been used thus far. All the points which have been highlighted are connected to the hull shape and consequences of this, and hence it is not the principle of providing a dynamic lift by submerged and controlled wings which is the main idea with this new construction, but it is the shape of that part of the wing which at speed lifts the craft above the water surface, and the cooperation between the design of the wing and its control surfaces, which are considered to be a new invention.

The foil system according to the invention is characterised in that the foil system is formed by one single horizontal foil body comprising generally mirror symmetric foil arms which extend aft to each side in equal angles, the forward apex of the foil arms lying in the centre line of the craft.

According to a preferred embodiment the ratio between the longitudinal extent of the foil body $L_F$ and the length of the craft $L_S$ is in the order of ⅓ to ⅘, and preferably in the order of ½ to ¾.

Further preferred embodiments of the foil system according to the invention appear from the further dependent patent claims.

According to the invention it is hence suggested to supply all the lift by means of one single wing which, in order to provide control in pitch, is fitted with control fins both in the forward apex (that is to say in the aft part of the forward apex) as well as on the two aft angled legs and which further is fitted with control fins symmetrically located on the two aft angle legs in order to provide control in roll. Additionally this wing is utilised on an unusual broad craft, which primarily, but not necessarily, must consist of several connected hulls, where use of several hulls would make it advantageous to make the outer hulls considerably more slender than the centre hull. In this way it is possible to obtain a considerably improved aspect ratio for the lifting wing, thus leading to less resistance than on known hydrofoil craft. By using as few control fins as three, which nonetheless will provide control in both pitch and roll, a more precise adjustment of the craft's motion will be obtained than if more control fins had been used.

In the following the invention will be further explained with reference to the figures, wherein.

Figure 1:
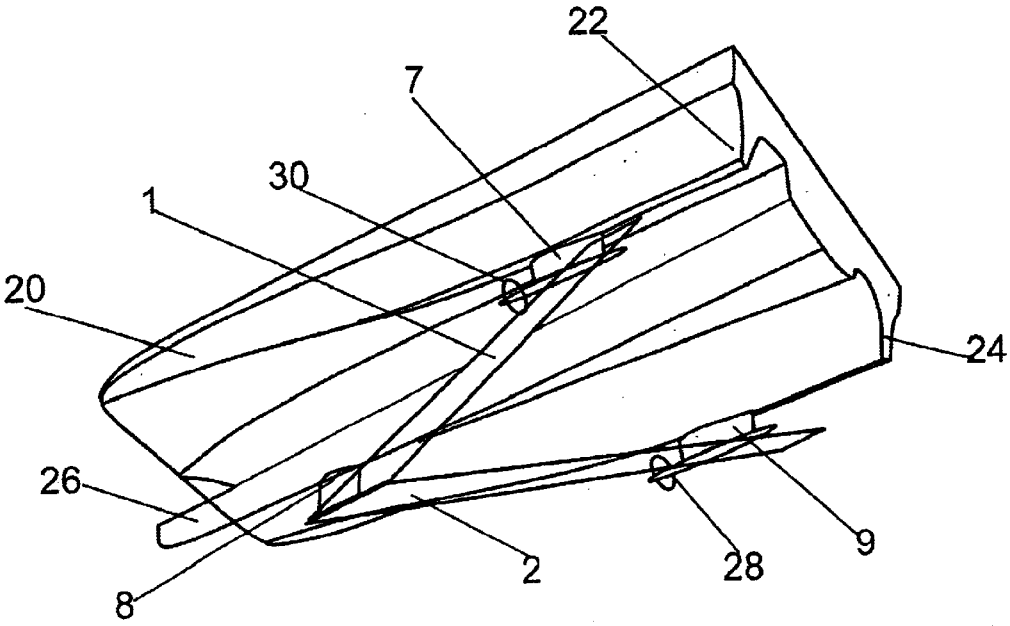
FIG. 1 shows a perspective view of the hull design, seen from below, and wherein the foil wing according to the invention is mounted.
Figure 2A:
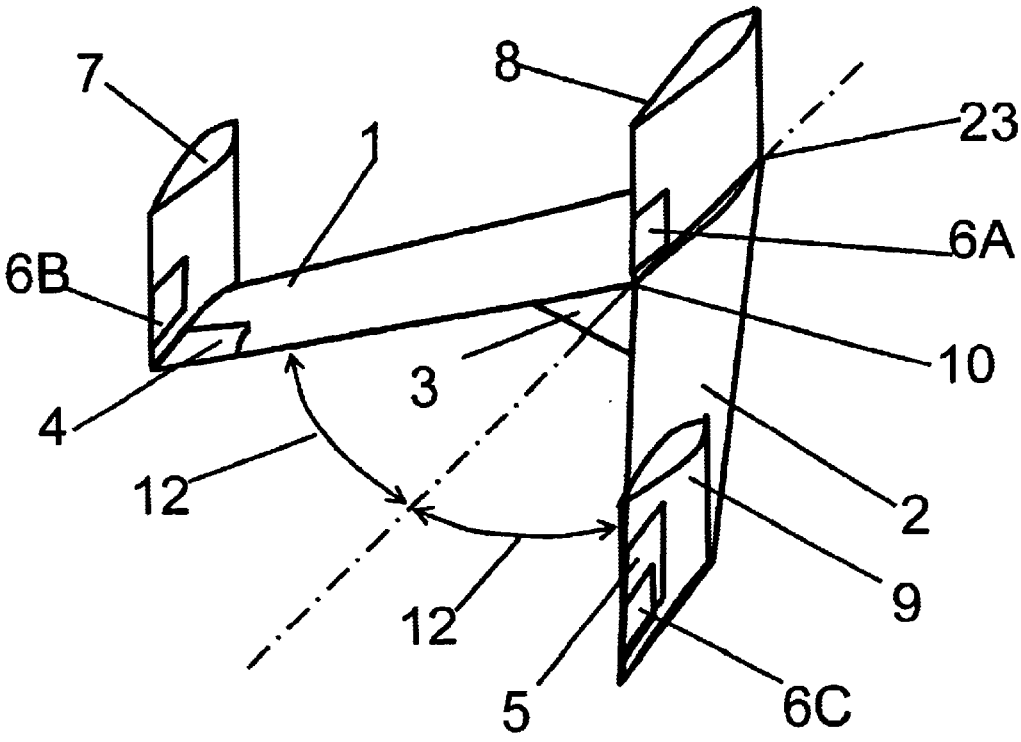
FIG. 2A shows a perspective view of the foil construction, seen from above.

Initially the invention will be explained with reference to the FIGS. 1 and 2, where FIG. 1 shows the underside of a hull 20 which has mounted the new foil system according to the invention, while FIG. 2 shows the foil system itself seen from above. The hull 20 may in itself comprise a conventional flatbottomed hull but in this embodiment it constitutes rear downward projecting longitudinal fins 22 20 and 24, respectively, on either side of the hull, and in addition to a forward central fin 26 intended for mounting of the foil via the respective struts, 7, 8, 9. At speed these fins will be positioned above the water surface. On FIGS. 1 and 3 it is illustrated as an example the craft being driven by propellers 28, 30 located to the leading edge of each aft strut 7, 9.

As shown in FIG. 2 the foil system comprises a primarily horizontal or plane foil body made up of two foil arms 1,2 with control fins (or control flaps) 3, 4, 5 and corresponding mainly vertical struts 7, 8, 9 attaching the foil to the above located hull 20. The foil is arranged to lift and carry the total weight of the craft at speed.

The two foil arms 1, 2 are plane and primarily mirror symmetric about the hull's centre line (or longitudinal axis) 11, and are joined in a mainly equal angle where the apex of the angle 23 lies on the centre line 11 of the craft, and the two foil arms protrude aft to each side in approximately equal angles 12 with the centre line 11 of the craft in a symmetric pattern. The hull is thus supported by the foil system by means of the three vertical struts 7, 8, 9 attached in their lower end to the foil arms, and in their upper end to the hull of the craft, e.g. to the fins as shown in FIG. 1.

Figure 2B:
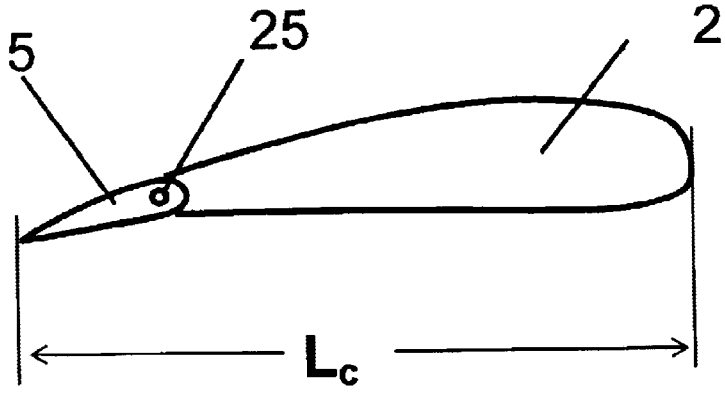
FIG. 2B shows a cross section of a foil.

The foils themselves have a cross section approximately similar to an airplane wing as will be evident from FIG. 2B in order to provide a lift from the sea. The vertical forces from the foil system are regulated by three independent control surfaces 3, 4, 5 which are generally horizontally hinged (shown with the axis 25 close to the foil's trailing edge in FIG. 2B), of which the first and forward control surface 3 is located at the centre line of the craft in the apex 10 of the foil system, i.e. at the trailing edge of the foil surface, while the second control surface 4 is located at the rear end of port foil arm (at the extremity of the arm 1), and the third control surface 5 is located on the starboard foil arm 2 approximately mirror symmetrical with the other arm in relation to the longitudinal centreline plane 11 of the craft. The outer struts 7, 9 are located at the rear end of the foil arms, respectively, or at some distance from this end.

Further the forward strut 8 comprises, between the hull of the craft and the foil system, a vertical control fin 6 which is hinged along the trailing edge of the strut (in principal equal to the horizontal control surfaces) correspondingly so that the fin may pivot about a vertical axis approximately in the corner 10 between the two foil arms 1, 2.

Hence the first centrally located control fin 3 combined with the aft control surfaces 4, 5 can control the craft in pitch (when the craft is moving against head waves), while the forward, vertically hinged control fin 6 in combination with the rear control fins 4, 5 can control the craft in roll movements (the waves are approaching from abeam).

The foil arms 1, 2 can be shaped with constant or variable chord length along its extension. In this case the chord length is taken to mean the sectional length in the longitudinal direction of the craft. The foil arms 1, 2 may have constant or dissimilar angle of attack in relation to a horizontal plane. According to the invention the number of control surfaces for controlling the vertical forces can be more than three, but always in a number and with a location to give approximate mirror symmetry about the centre plane 11 of the craft.

Additionally the control fins of the foil system is regulated in mutually programmed relation, and are adapted to the need for navigation, or the demands caused by the waves, so that the foil system shall perform the required vertical and/or horizontal forces.

The number of vertical struts 3 between the hull and the foil system is 3 (as in the current case) or any other odd number and with a location which gives approximately mirror symmetry about the centre line of the craft.

Extent of the foil in relation to the length of the hull. The foil wing according to the invention is mounted to the hull in agreement with accurate calculations related to the centre of gravity and the length of the craft. To ensure that the craft shall reach a satisfactory equilibrium the longitudinal extent of the foil should be adapted to the length of the craft. It is assumed that a suitable ratio between the longitudinal length of the foil system $L_F$ and the length of the craft $L_S$ is in the range of ⅓ to ⅘, although there may be situations where this ratio could be greater than ⅘. Especially favourable are length ratios between ½ and ¾.

Figure 3:
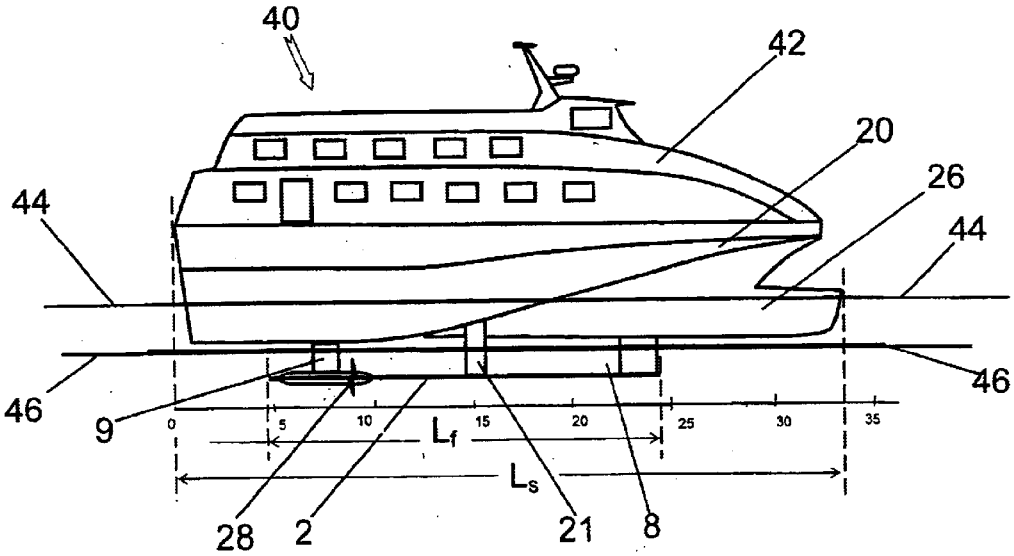
FIG. 3 shows a side view of a craft with the invented foil design mounted.

FIG. 3 shows a side view of a hydrofoil craft 40 with superstructure 42 mounted on the hull construction 20 according to FIG. 1. The craft embodies the invented foil design. The foil comprises in addition an extra central strut 21 on each foil arm between the struts 8 and 9, and between 8 and 7, respectively. When the craft is stationary the weight of the craft is carried by hydrostatic force from the hull which is below the waterline 44. When the craft operates at speed the complete hull is lifted above the water. Only the struts and the horizontal foil are submerged, and the weight of the craft is totally carried by dynamic forces from the single foil. For this situation the waterline is shown by the reference number 46.

What is claimed is:

1. A foil system for mounting on an underside of a hull, said system comprising a horizontally disposed foil body having a pair of arms disposed in symmetrical angular relation to a longitudinal axis;

a plurality of vertically disclosed struts mounted on said body, one of said struts being disposed on said axis and the other of said struts being disposed symmetrically of said axis; and at least three control surfaces disposed symmetrically of said axis, one of said control surfaces being pivotally mounted on and between said arms of said foil body, a second of said control surfaces being pivotally mounted on a trailing edge of one of said arms and a third of said control surfaces being pivotally mounted on a trailing edge of the other of said arms.

2. A foil system as set forth in claim 1 further comprising a control fin pivotally mounted on a trailing edge of said one strut for pivoting about a vertical axis.

3. A foil system as set forth in claim 1 wherein each arm has a constant chord length.

4. A foil system as set forth in claim 1 wherein each arm has a constant angle of attack relative to a horizontal plane.

5. A foil system as set forth in claim 1 further comprising a control fin pivotally mounted on a trailing edge of each said strut for pivoting about a vertical axis.

6. In combination;

a hull for a ship; and a foil system secured to an underside of said hull for supporting said hull above a waterline line during travel, said foil system comprising a horizontally disposed foil body having a pair of arms disposed in symmetrical angular relation to a longitudinal axis of said hull, a plurality of vertically disposed struts mounted on said body, one of said struts being disposed on said axis and the other of said struts being disposed symmetrically of said axis and at least three control surfaces disposed symmetrically of said axis, one of said control surfaces being pivotally mounted on and between said arms of said foil body, a second of said control surfaces being pivotally mounted on a trailing edge of one of said arms and a third of said control surfaces being pivotally mounted on a trailing edge of the other of said arms.

7. The combination as set forth in claim 6 further comprising a control fin pivotally mounted on a trailing edge of said one strut for pivoting about a vertical axis.

8. The combination as set forth in claim 6 wherein each arm has a constant chord length.

9. The combination as set forth in claim 6 wherein each arm has a constant angle of attack relative to a horizontal plane.

10. The combination as set forth in claim 6 further comprising a control fin pivotally mounted on a trailing edge of each said strut for pivoting about a vertical axis.

11. The combination as set forth in claim 6 wherein the overall longitudinal length of said foil system relative to the longitudinal length of said hull is in the range of from 1:3 to 4:5.

12. The combination as set forth in claim 6 wherein the overall longitudinal length of said foil system relative to the longitudinal length of said hull is in the range of from 1:2 to 3:4.

13. In combination;

a hull for a ship; and a foil system secured to an underside of said hull for supporting said hull above a waterline line during travel, said foil system comprising a horizontally disposed foil body having a pair of arms disposed in symmetrical angular relation to a longitudinal axis of said hull and a plurality of vertically disposed struts mounted on said body, one of said struts being disposed on said longitudinal axis and the other of said struts being disposed symmetrically of said longitudinal axis, said foil system having an overall longitudinal length relative to the longitudinal length of said hull in the range of from 1:3 to 4:5 and at least three control surfaces disposed symmetrically of said axis, one of said control surfaces being pivotally mounted on and between said arms of said foil body, a second of said control surfaces being pivotally mounted on a trailing edge of one of said arms and a third of said control surfaces being pivotally mounted on a trailing edge of the other of said arms.

14. The combination as set forth in claim 13 wherein the overall longitudinal length of said foil system relative to the longitudinal length of said hull is in the range of from 1:2 to 3:4.

15. The combination as set forth in claim 13 further comprising a control fin pivotally mounted on a trailing edge of said one strut for pivoting about a vertical axis.

16. A method of navigating a ship having a hull and a foil system secured to an underside of said hull for supporting said hull above a waterline line during travel, said foil system comprising a horizontally disposed foil body having a pair of arms disposed in symmetrical angular relation to a longitudinal axis of said hull and a plurality of vertically disposed struts mounted on said body, one of said struts being disposed on said axis and the other of said struts being disposed symmetrically of said axis, at least three control surfaces disposed symmetrically of said axis, one of said control surfaces being pivotally mounted on and between said arms of said foil body, a second of said control surfaces being pivotally mounted on a trailing edge of one of said arms and a third of said control surfaces being pivotally mounted on a trailing edge of the other of said arms and a control fin pivotally mounted on a trailing edge of said one strut for pivoting about a vertical axis, said method comprising the steps of pivoting said control fin in synchronism with pivoting of said second control surface and said third control surface to control the pitch of said ship.

17. A method as set forth in claim 6 further comprising the step of pivoting said three control surfaces in synchronism to control the roll of said ship.

* * * * *